US006079077A

United States Patent [19]

Kajihara et al.

[11] Patent Number: 6,079,077

[45] Date of Patent: Jun. 27, 2000

[54] UPRIGHT TYPE VACUUM CLEANER CAPABLE OF SWITCHING BETWEEN SUCTION PATH CORRESPONDING TO PLACE TO BE CLEANED

[75] Inventors: Shinichiro Kajihara, Sakai; Noboru Nishinaka, Wakayama; Kazuo Kito, Yao, all of Japan

[73] Assignee: Sharp Kabushiki Kaisha, Osaka, Japan

[21] Appl. No.: 09/080,462

[22] Filed: May 19, 1998

[30] Foreign Application Priority Data

May 21, 1997 [JP] Japan ..... 9-131087

[51] Int. Cl.[7] ..... A47L 9/24; A47L 5/36

[52] U.S. Cl. ..... 15/332; 15/331; 15/334; 15/335

[58] Field of Search ..... 15/331, 332, 334, 15/335

[56] References Cited

U.S. PATENT DOCUMENTS

| | | | |
|---|---|---|---|
| 3,869,751 | 3/1975 | Boyd et al. | 15/334 |
| 4,959,885 | 10/1990 | Sovis et al. | 15/335 |
| 5,243,734 | 9/1993 | Maurer et al. | 15/334 |
| 5,351,361 | 10/1994 | Buchtel | 15/334 |
| 5,355,549 | 10/1994 | Steinberg et al. | 15/334 |
| 5,560,074 | 10/1996 | Graham et al. | 15/323 |

FOREIGN PATENT DOCUMENTS

| | | |
|---|---|---|
| 62-45629 | 12/1987 | Japan . |
| 2090945 | 7/1982 | United Kingdom . |
| 2291336 | 1/1996 | United Kingdom . |
| 8500277 | 1/1985 | WIPO . |

*Primary Examiner*—Terrence R. Till
*Assistant Examiner*—Theresa T. Snider

[57] ABSTRACT

A dust collecting direction switching portion is provided at a wall at the back of the main body of an upright type vacuum cleaner. The dust collecting switching portion having a switch valve is branched into three directions. The branch in the first direction forms a duct for allowing a coupling hose to be fitted to a suction opening directed toward a floor surface, the branch in the second direction forms a rib communicating with a dust collecting portion inside the vacuum cleaner, and the branch in the third direction forms a rib allowing a hose to collect dust at a relatively narrow space between pieces of furniture. In operation, in response to an operation of a knob related to the switch valve, the switch valve switches one of the first and third direction ducts in association with the operation to communicate with the rib in the second direction.

20 Claims, 7 Drawing Sheets

UPRIGHT TYPE VACUUM CLEANER CAPABLE OF SWITCHING BETWEEN SUCTION PATH CORRESPONDING TO PLACE TO BE CLEANED

BACKGROUND OF THE INVENTION

1. Field of the Invention

The present invention relates generally to upright type vacuum cleaners, and more particularly, to an improved upright type vacuum cleaner capable of switching the suction path between when a wide plane is cleaned and when a narrow space is cleaned.

2. Description of the Related Art

A so-called canister type vacuum cleaner can relatively easily clean any part of a room by changing the suction opening at the tip end of a hose attached to the main body. The canister type vacuum cleaner is dragged on the floor while in use, anybody having a dislike for such way of using the cleaner prefers an upright type vacuum cleaner.

The upright type vacuum cleaner generally has its wide suction opening contacted to the floor, and special preparation as follows is necessary to attach a narrow space nozzle to the cleaner. More specifically, a suction hose is normally attached to the main body, and the suction hose is detached from the main body and the narrow space nozzle is attached instead when relatively narrow spaces at corners of a room for example are cleaned. The suction hose of the upright type vacuum cleaner is short, and its one end is fixed to the main body, the suction hose does not smoothly follow the movement of the cleaner when the narrow space nozzle is attached and operated. In order to solve the drawback, an upright type vacuum cleaner as disclosed by Japanese Utility Model Publication No. 62-45629 has been proposed.

FIG. 6 is a rear perspective view for use in illustration of how to use the upright type vacuum cleaner disclosed by Japanese Utility Model Publication No. 62-45629. FIG. 7 is a cross sectional view of the upright type vacuum cleaner shown in FIG. 6 having its suction hose attached to the power nozzle for the floor. In order to solve the above-described disadvantage, in the upright type vacuum cleaner shown in FIGS. 6 and 7, one end of a suction hose 111 is connected by a rotary connection portion to a dust collecting portion 104 through a miter bend 110. Dust collecting portion 104 is stored inside the upper part 101 of the main body. An electromotive fan 103 is stored in the lower part 102 of the main body. A power nozzle 112 is pivotably attached to the lower part 102 of the main body. If the upper and lower parts 101 and 102 of the main body are inclined, power nozzle 112 is always closely in contact with the floor.

When the floor surface is cleaned, air taken in from the suction opening 116 of power nozzle 112 at the floor is passed through a connection hose 115, suction hose 111 connected to a connection opening 113, and miter bend 110 pivotably connected-to the suction hole 108 of the dust collecting portion 104 to be taken into dust collecting portion 104, has its dust removed by a filter 107 and exhausted from an exhaust 132.

When narrow space nozzle 129 is used, suction hose 111 is disconnected from connection hole 113, and narrow space nozzle 129 detachably attached at a holding portion 130 at the back of the upper part 101 of the main body is connected to suction hose 111 for cleaning.

As shown, a rotary brush 117 is rotated by a pulley 120 driven by a belt 118 from the output shaft 119 of electromotive fan 103. The rotating force is controlled by a switching lever 121. The upright type vacuum cleaner as shown includes a bumper 122 for protecting power nozzle 112, a handle 124 used by the user for operating the cleaner and a power supply cord 125.

In the structure of the upright type vacuum cleaner described above, suction hose 111 is detached from connection hole 113, each time a narrow space or furniture is cleaned, an attachment such as an extension tube and a nozzle for the purpose is attached to connection pipe 114 at the tip end of suction hose 111. As a result, suction hose 111 should be detached from connection hole 113, each time furniture is cleaned during cleaning the floor, which is inconvenient for the user.

SUMMARY OF THE INVENTION

It is an object of the present invention to provide an upright type vacuum cleaner capable of easily switching the suction path between when a wide plane is cleaned and when a narrow space is cleaned.

In order to achieve the object, the upright type vacuum cleaner according to the present invention has a dust collecting direction switching portion at the wall of the main body. The dust collecting direction switching portion includes a first opening for communicating with the dust collecting portion provided in the main body, a second opening for coupling to the suction path directed to the floor surface, a third opening for coupling to the suction opening which can be directed in an arbitrary direction, and a switch valve for switching one of the second and third openings to be in communication with the first opening.

Thus, one of the second and third openings is switched to be in communication with the first opening only by the switch valve, the suction opening of the upright type vacuum cleaner may be readily switched corresponding to the space to be cleaned such as a wide space like a floor surface and a narrow space like a gap between pieces of furniture.

The dust collecting directing switching portion further includes first to third rib portions for independently forming the first to third openings and a cover detachably provided to cover the rib portions.

Therefore, by removing the cover, the dust collecting direction switching portion including the first to third rib portions may be readily cleaned.

The first to third rib portions are formed integrally with the wall surface of the upright type vacuum cleaner. Thus, the manufacturing cost of the upright type vacuum cleaner may be lowered. Thus providing the dust collecting direction switching portion will not prevent reduction in the size of the upright type vacuum cleaner.

In the upright type vacuum cleaner, the suction opening directed in an arbitrary direction is used for taking in dust at a relatively narrow space.

The upright type vacuum cleaner further has an operation portion for externally operating the dust collecting directing switching portion and the switch valve is switched based on the operation of the operation portion.

As a result, the user may switch the suction path of the upright type vacuum cleaner corresponding to a space to be cleaned, simply by operating the operation portion.

The operation portion and switch valve are integrally formed. Therefore, thus providing the operation portion in association with the dust collecting direction switching portion will not prevent the size of the upright type vacuum cleaner from being reduced.

The switch valve is switched, taking advantage of the urging force of a spring operating in connection with the operation of the operation portion. The user may switch the valve by the movement of the spring, simply by a single operation, more specifically, the suction opening may be switched simply by a single operation, and therefore the operability of the upright vacuum cleaner is improved.

The upright type vacuum cleaner has its one opening end coupled to the suction opening which can be directed in an arbitrary direction, the other opening end has a hose in communication with the second opening, and the hose is rotatably provided at the coupling portion between the other opening end and the second opening.

As a result, the suction opening coupled to the one opening end of the hose may be freely directed in an arbitrary direction, which improves the operability of the upright type vacuum cleaner.

The second opening and the coupling portion of the hose are formed of an elastic member. As a result, the suction opening coupled to the one opening end of the hose coupled to the second opening may be freely directed in an arbitrary direction, which further improves the operability of the upright type vacuum cleaner.

A portion for preventing the other opening end of the hose from coming off from the second opening may be readily formed at the elastic member.

The other opening end of the hose is detachably connected to the second opening, which allows the inside of the hose to be readily cleaned.

The suction opening coupled to the one opening end of the hose and directed in an arbitrary direction is an attachment for the upright type vacuum cleaner and is detachably provided at the one opening end of the hose for collecting dust at a relatively narrow space.

The attachment is an extension tube or a narrow space nozzle for extending the one opening end of the hose to provide the suction opening which can be directed in an arbitrary direction.

The second or third opening has a tapered fitting portion. Thus, the hose connected to the second or third opening may be detachable, and may be readily cleaned.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
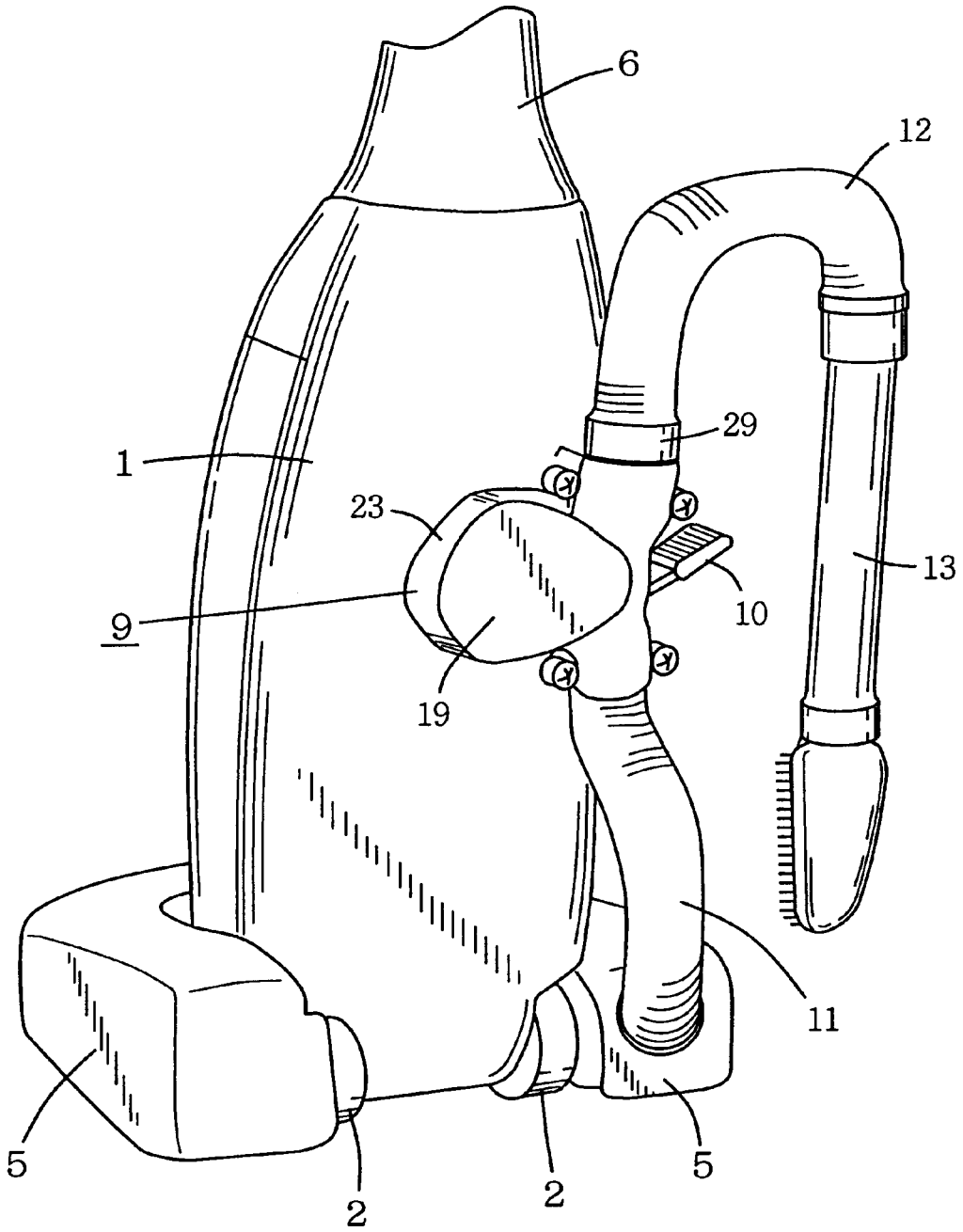
FIG. 1 is a rear perspective view of an upright type vacuum cleaner according to an embodiment of the invention.
Figure 2:
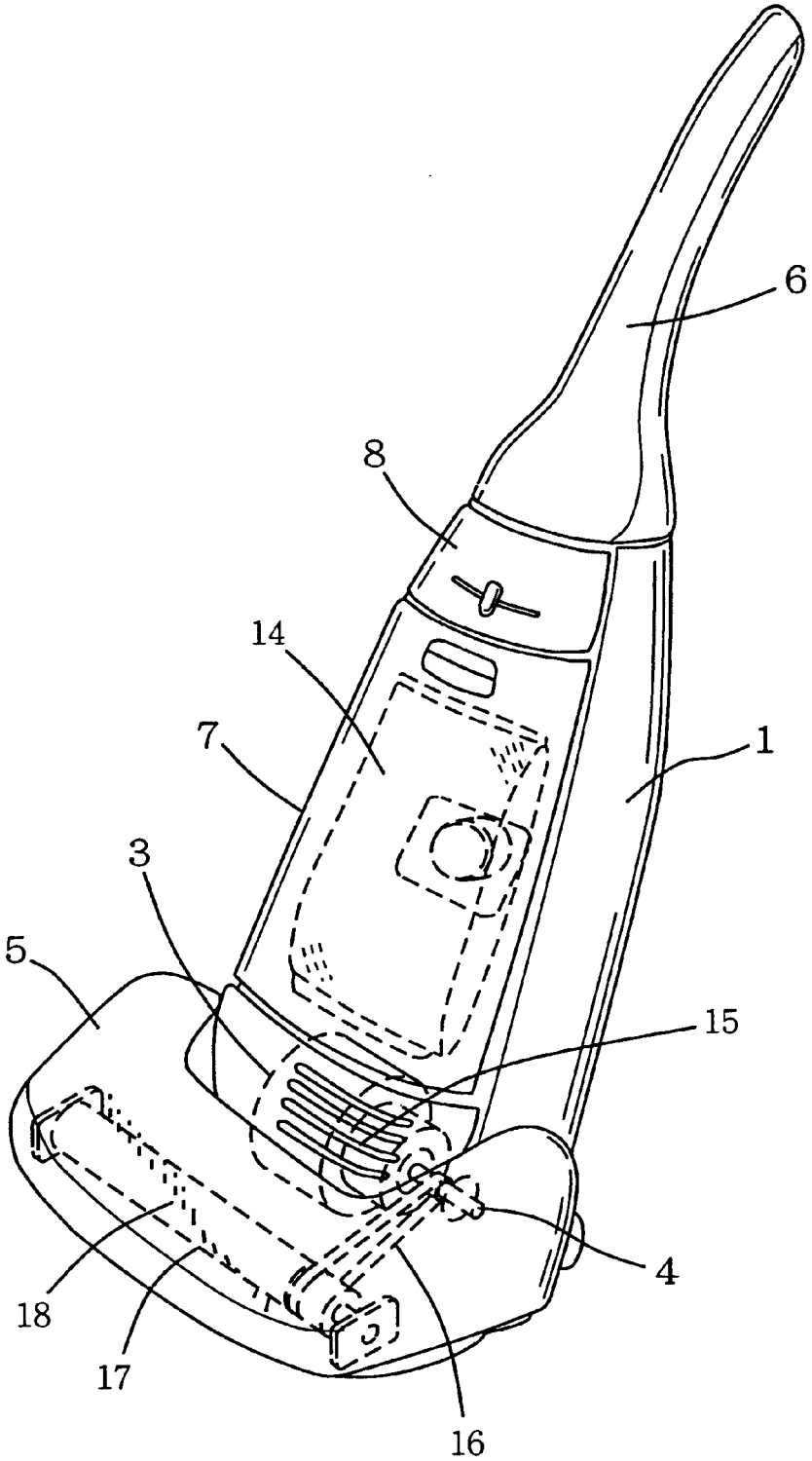
FIG. 2 is a front perspective view of the upright type vacuum cleaner according to the embodiment of the invention.

An embodiment of the present invention will be now described in detail in conjunction with the accompanying drawings. Referring to FIGS. 1 and 2, the main body 1 of an upright type vacuum cleaner according to the embodiment of the present invention has wheels 2 at the bottom, and a fan motor 3 stored in its lower part. The coaxial shaft 4 of fan motor 3 serves as a point for pivotally attaching a suction opening body 5 for the floor and main body 1, and main body 1 and suction opening body 5 are pivotable around coaxial shaft 4. A handle 6 is fixed at the upper part of main body 1, and a dust collecting case 7 is attached detachably inside the front surface of main body 1. A panel 8 provided at the upper part of main body 1 and externally operated has inside a power control substrate for controlling the input of fan motor 3. The above-described structure is substantially the same as the conventional example.

At the back of main body 1 attached is a dust collecting switching portion 9 branching into three paths inside. Dust collecting direction switching portion 9 is provided with a knob 10 pivoted in response to an external operation. By the pivotal movement of knob 10, dust passing through hose 12 communicating with extension tube 13 for cleaning a place inaccessible by suction opening body 5 such as furniture or a narrow space between pieces of furniture is collected into a dust collecting bag 14 provided at dust collecting case 7, and air removed of the dust is exhausted from exhaust 15.

As is the case with the conventional example, the coaxial shaft 4 of fan motor 3 is attached with a belt 16 for driving rotary brush 18 facing the opening 17 of suction opening body 5 in association with the rotation of fan motor 3.

Figure 6:
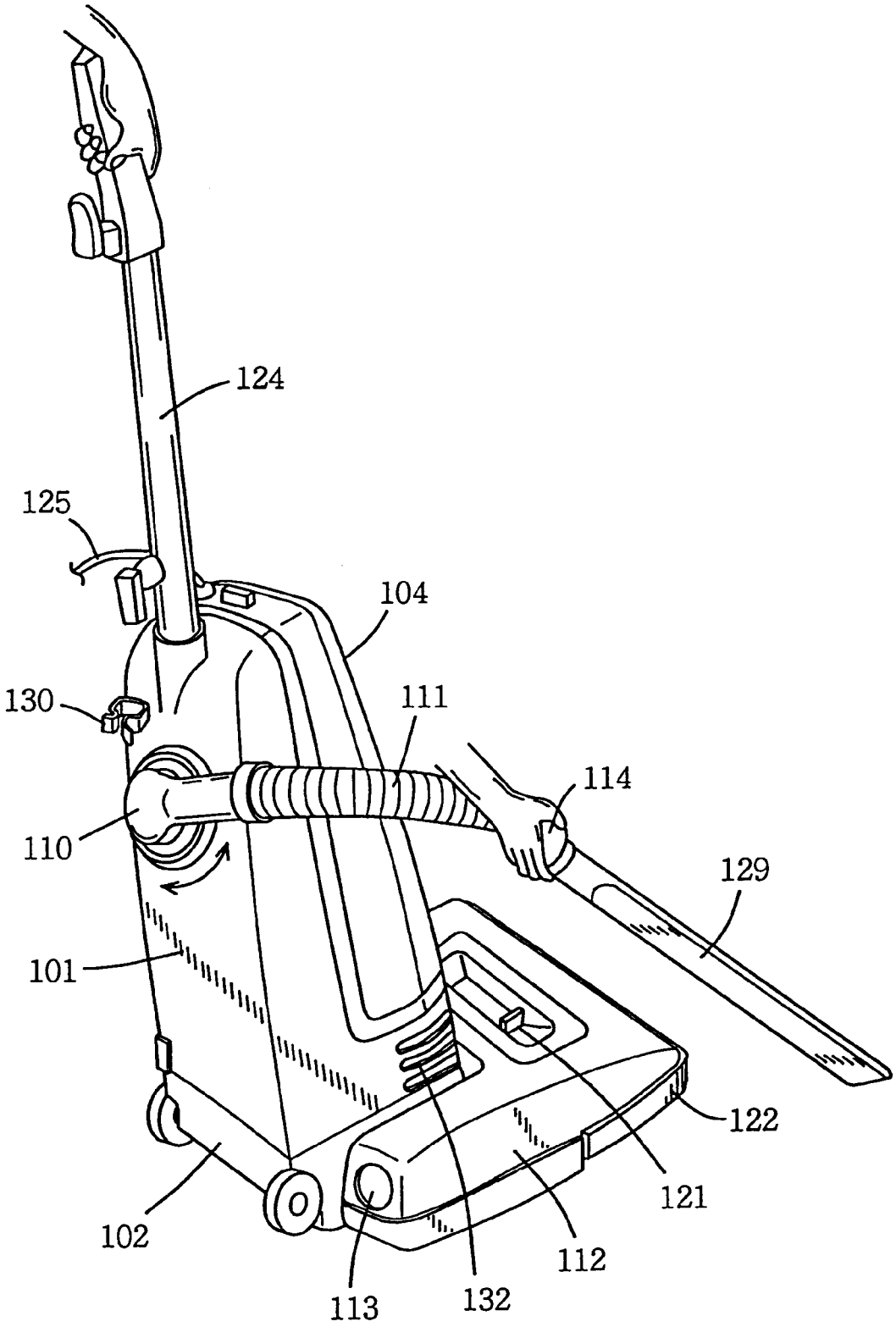
FIG. 6 PRIOR ART
FIG. 6 is a rear perspective view for use in illustration of how to use an upright type vacuum cleaner disclosed by Japanese Utility Model Publication No. 62-45629.
Figure 7:
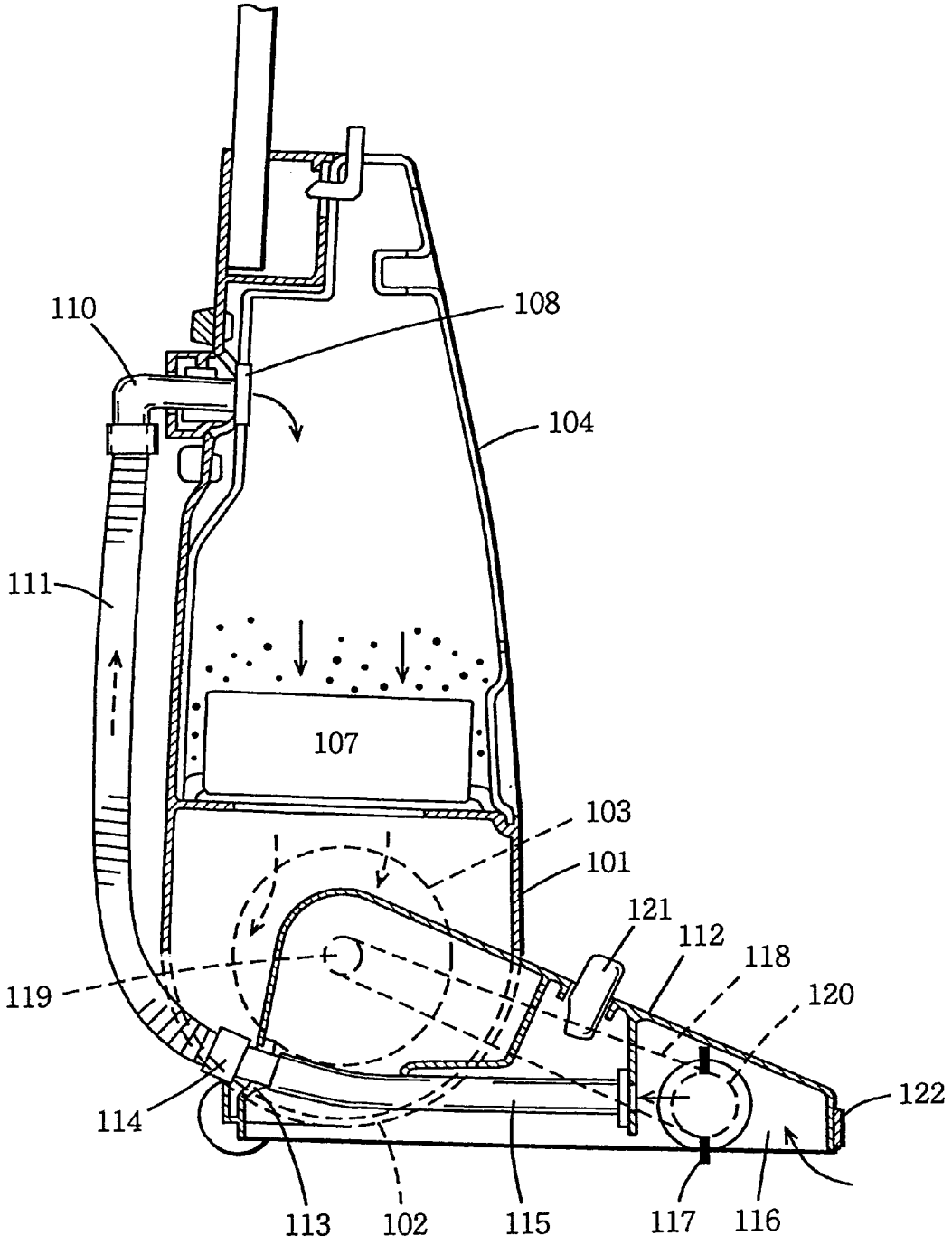
FIG. 7 PRIOR ART
FIG. 7 is a cross sectional view of the upright type vacuum cleaner in FIG. 6 having a suction hose attached to a power nozzle for the floor.

The attachment to the upright type vacuum cleaner detachably provided to hose 12 may be an extension tube 13 or a narrow space nozzle as shown in FIG. 6.

Figure 3:
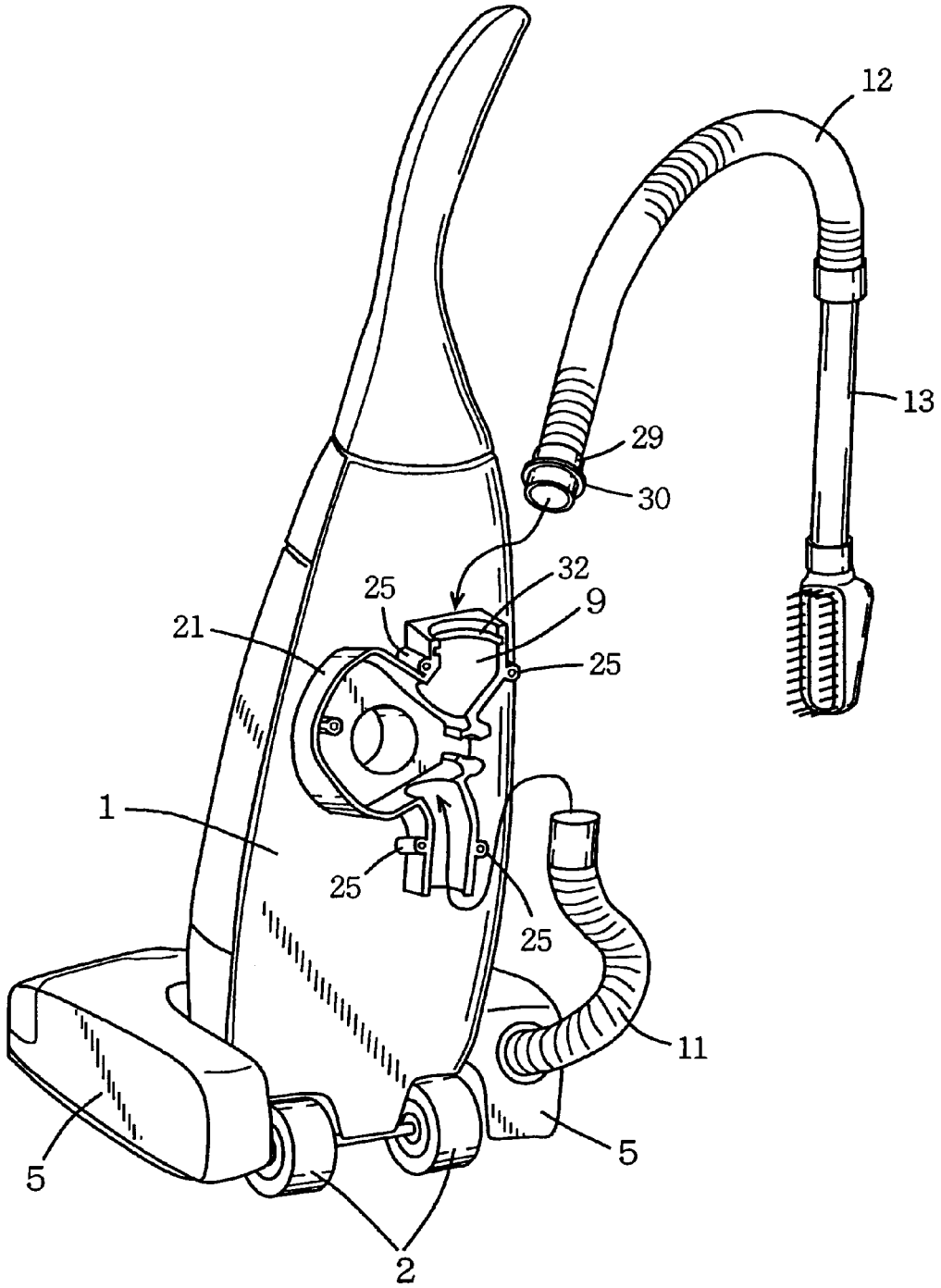
FIG. 3 is an exploded perspective view of the upright type vacuum cleaner according to the embodiment of the invention in the vicinity of a dust collecting direction switching portion at the back.

In FIGS. 3, 4, 5A and 5B, dust collecting direction switching portion 9 at the back of main body 1 includes a dust collecting direction switching portion cover 19, a rib-shaped dust collecting direction switching portion main body 23 engaging therewith, and a switch valve 20 integrally formed with knob 10. In FIG. 3, knob 10 and dust collecting switching portion cover 19 are not shown.

The wall of dust collecting direction switching portion 9 on the side of main body 1 may be the wall of main body 1 at the back side. Switch valve 20 and a spring 22 are provided in dust collecting direction switching portion 9. One end of spring 22 is fixed at an end 33 of switch valve 20, and the other end is pivotally attached to a socket 21 provided at main body 1. Switch valve 20 penetrates through dust collecting direction switching portion main body 23 projecting from the wall, and is pivotably provided. Switch valve 20 is engaged with the engaging portion 35 of dust collecting direction switching portion main body 23 by a boss portion 34, and pivots around the engaged portion. Switch valve 20 has knob 10 for externally operating switch valve 20. As shown, switch valve 20 and knob 10 are integrally formed, and therefore dust collecting direction switching portion 9 may be formed compactly. As shown in FIG. 3, the wall at the back of main body 1 and main body 23 may be formed integrally, and therefore the manufacturing cost of dust collecting direction switching portion 9 and thus the cost of the entire upright type vacuum cleaner may be reduced. Note that dust collecting direction switching portion 9 may be built in main body 1.

Dust collecting direction switching portion main body 23 has a shape branching into three directions. The branch in first direction forms a duct 23A for fitting hose 11 coupled to suction opening body 5, the branch in the second direction forms a duct 23B for communicating with a dust collecting portion formed of the dust collecting bag 14 and dust collecting case 7 of main body 1, and the branch in the third direction forms a duct 23C for fitting hose 12 to which an attachment is provided.

There are provided a plurality of bosses 25 for screwing dust collecting direction switching portion cover 19. Thus, dust collecting direction switching portion cover 19 is detachably provided to main body 1.

Figure 5A:
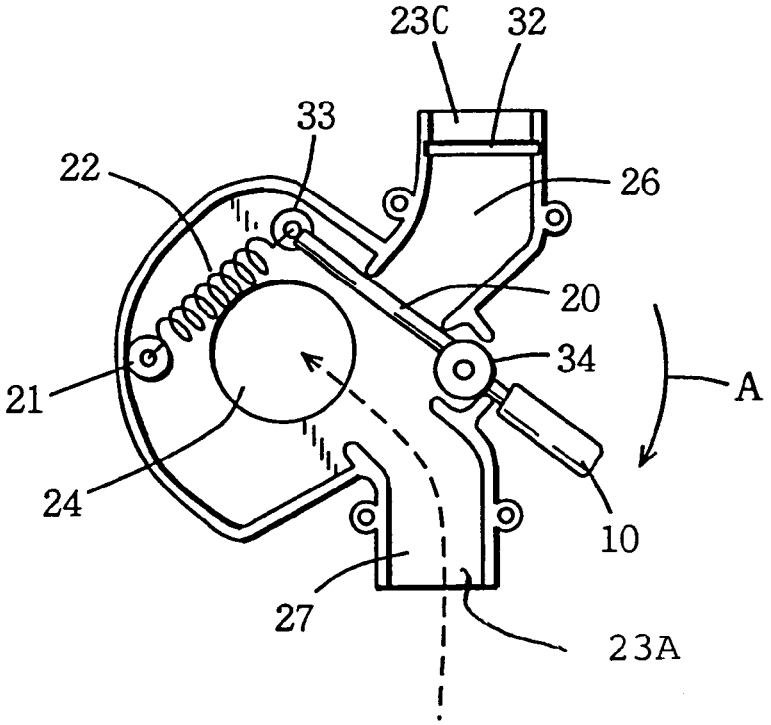
FIGS. 5A and 5B are cross sectional views for use in illustration of the switching operation of the dust collecting direction switching portion according to the embodiment of the invention.
Figure 5B:
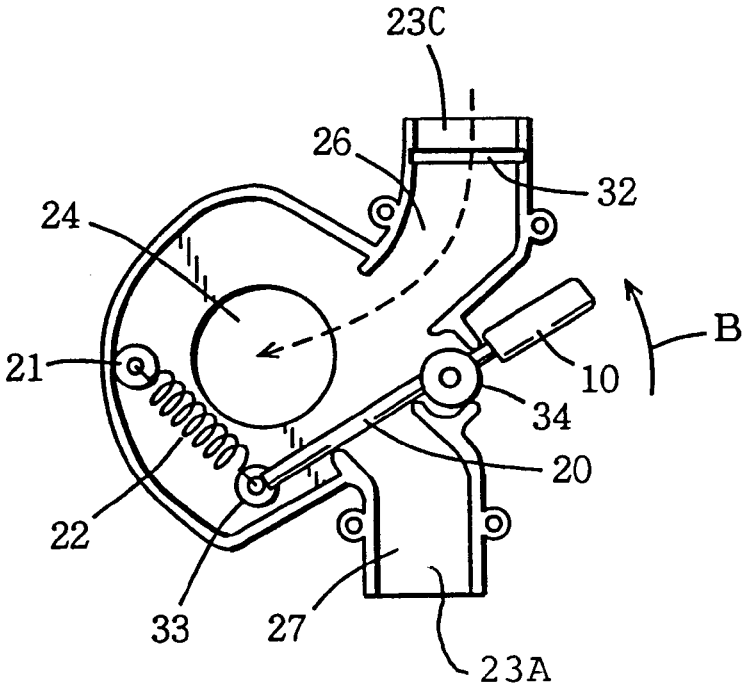

The operation of dust collecting direction switching portion 9 will be now described in conjunction with FIGS. 5A and 5B. As knob 10 in FIG. 5A starts pivoting in direction of arrow A, spring 22 gradually deforms. After a prescribed transition point, the urging force of spring 22 causes switch valve 20 to be switched and fixed at the position in FIG. 5A. Switch valve 20 closes opening 26 coupled to hose 12, air including dust passing through hose 11 coupled to suction opening body 5 is taken in in the direction of the opening 24 of main body 1. Conversely, when knob 10 in FIG. 5A is moved in the direction of arrow B in FIG. 5B, the urging force of spring 22 similarly acts upon switch valve 20 to be switched to close opening 27 of hose 11 coupled to suction opening body 5, and therefore air including dust passing through hose 12 coupling the attachment to main body 1 is drawn in in the direction of dust bag opening 24 of main body 1. By externally operating knob 10 to pivot in the direction of arrow A or B, an air path in only a single direction is formed by switch valve 20 in the duct portion of dust collecting direction switching portion 9 branching into two directions. Note that the constant related to spring 22 is desirably determined, taking into account air pressure caused by air passing through the duct portion.

Figure 4:
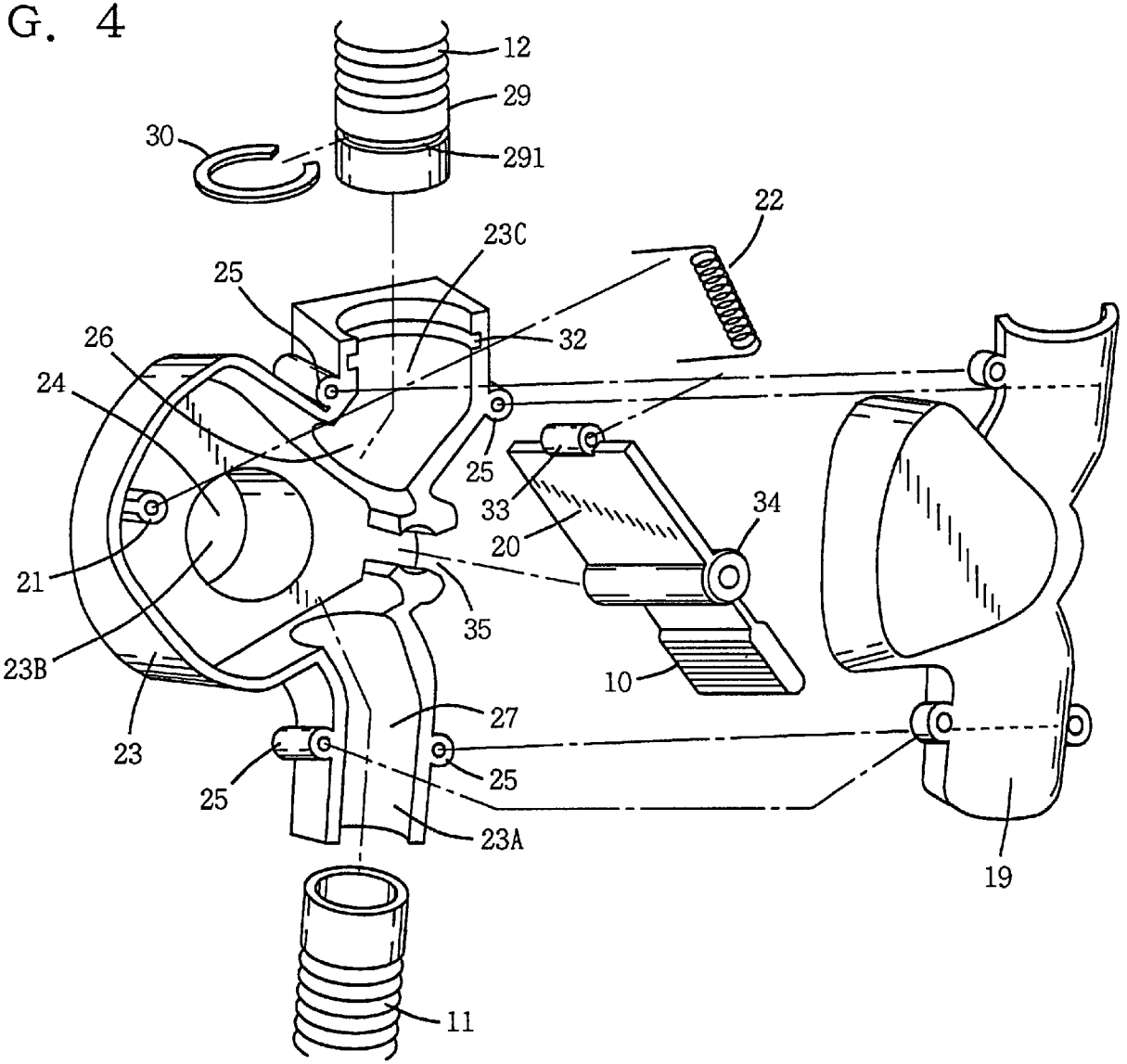
FIG. 4 is an exploded perspective view of the dust collecting direction switching portion in FIG. 1.

In FIG. 4, a pipe 29 fixed at one opening end of hose 12 is fitted into an opening 26. Pipe 29 is formed of an elastic member. Pipe 29 has a groove 291, at which a ring 30 is fitted. Ring 30 thus fits to the groove portion 32 of duct 23C and the groove portion (not shown) of dust collecting direction switching portion cover 19, and pipe 29 is attached to main body 1 (dust collecting direction switching portion main body 23). Pipe 29, as fitted between duct 23C and dust collecting direction switching cover 19, is prevented from coming off by ring 30, which rotates along the groove portion, so that the attached hose 12 may be rotated around the connecting portion between pipe 29 and duct 23C. The opening on the opposite side to the duct 23C of hose 12, in other words an extension tube 13 or a narrow space nozzle connected to hose 12 may be readily directed in an arbitrary direction.

Since the ducts 23A and 23C of main body 1 (dust collecting direction switching portion main body 23) are tapered, and therefore each of these ducts and hose 12 and hose 11 coupling suction opening body 5 may be readily fit. As a result, if dust blocks hose 11 or 12 during cleaning, hose 11 or 12 may be readily pulled out from duct 23A or 23C for removal of the dust.

When the floor is cleaned using the upright type vacuum cleaner according to the present invention and a narrow space between pieces of furniture or a place not accessible by the suction opening body 5 of the vacuum cleaner such as a place under a bed is cleaned, switch valve 20 needs only be switched by a single operation without having to remove hose 11 from suction opening body 5 every time. Dust collecting direction switching portion 9 includes a duct portion integrally formed at the wall surface of main body 1 projecting from the main body and cover 19 fitting thereto, and therefore cover 19 may be readily detached for cleaning switch valve 20 inside. Since hose 12 is rotatably connected to in the dust collecting direction switching portion 9, hose 12 may be used at various angles during cleaning, which improves the operability of the upright type vacuum cleaner.

Hose 12 may be readily attached to dust collecting direction switching portion 9, since the fitting portion, duct 23A is tapered.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An upright type vacuum cleaner having means for switching the direction of collecting dust comprising:

dust collecting direction switching means including a first opening in a switch housing for communicating with a dust collecting portion provided inside a main body of the vacuum cleaner, a second opening in the housing for communicating with a suction opening directed toward a floor surface to be cleaned, a third opening for coupling with a suction opening which can be directed in selected arbitrary directions and a switch valve flap for switching one of said second and third openings to be in communication with said first opening; and a hose having one opened end coupled to said suction opening which can be directed in the arbitrary direction and another opened end communicating with said second opening, said hose being rotatable at a coupling portion between said the other opened end and said second opening.

2. The upright type vacuum cleaner as recited in claim 1, wherein said dust collection direction switching means further includes first, second and third ducts for individually forming said first, second and third openings, and a cover provided to detachably cover said ducts.

3. The upright type vacuum cleaner as recited in claim 2, wherein said ducts are integrally formed with the wall of said switch housing.

4. The upright type vacuum cleaner as recited in claim 3, wherein said second opening is tapered so as to frictionally couple to said suction opening.

5. The upright type vacuum cleaner as recited in claim 1, wherein said switch valve flap has an operation portion for external operation, and said switch valve flap being switched in response to manual operation of said operation portion.

6. The upright type vacuum cleaner as recited in claim 5, wherein said operation portion and said switch valve flap being integrally formed.

7. The upright type vacuum cleaner as recited in claim 6, wherein said switch valve flap being switched using the urging force of a spring operating in association with the operation of said operation portion.

8. The upright type vacuum cleaner as recited in claim 1, wherein a coupling portion between said hose and said second opening is formed of an elastic member.

9. The upright type vacuum cleaner as recited in claim 1, wherein said the other opened end of said hose is detachably connected to said second opening.

10. The upright type vacuum cleaner as recited in claim 1, wherein said suction opening which is coupled to said one opened end of said hose and can be directed in an arbitrary direction is an attachment for the upright type vacuum cleaner, said attachment being provided detachably at said one opened end for collecting dust from a relatively narrow space.

11. The upright type vacuum cleaner as recited in claim 10, wherein said attachment is an extension tube or a narrow space nozzle for extending said one opened end of said hose to provide said suction opening which can be directed in the arbitrary direction.

12. An upright type vacuum cleaner having means for switching the direction of collecting dust comprising:

dust collecting direction switching means including a first opening in a switch housing for communicating with a dust collecting portion provided inside a main body of the vacuum cleaner, a second opening in the housing for communicating with a suction opening directed toward a floor surface to be cleaned, a third opening for coupling with a suction opening which can be directed in selected arbitrary directions and a switch valve flap for switching one of said second and third openings to be in communication with said first opening;

said switch valve flap having an actuator portion for external operation;

said switch valve flap being switched in response to manual operation of said actuator portion;

said actuator portion and said switch valve flap being integrally formed, and pivotally mounted in a wall of the switch housing about an integrally formed pivot shaft therebetween;

said switch valve flap being switched using the urging force of a spring operating in association with the operation of said actuator portion; and said spring having first and second distal ends, one distal end being pivotally coupled to a socket in said valve flap and the other distal end being pivotally coupled to a socket in said housing at a point on a line symmetrically disposed between the first and third openings to thereby provide over center snap-action of the valve flap between the first and third openings in response to manual movement of the actuator end.

13. The upright type vacuum cleaner as recited in claim 12, wherein said dust collection direction switching means further includes first, second and third ducts for individually forming said first, second and third openings, and a cover provided to detachably cover said ducts.

14. The upright type vacuum cleaner as recited in claim 13, wherein said ducts are integrally formed with the wall of said switch housing.

15. The upright type vacuum cleaner as recited in claim 14, wherein said second opening is tapered so as to frictionally couple to said suction opening.

16. The upright type vacuum cleaner as recited in claim 12, wherein a coupling portion between a hose and said second opening is formed of an elastic member.

17. The upright type vacuum cleaner as recited in claim 12, wherein said the other opened end of a hose is detachably connected to said second opening.

18. The upright type vacuum cleaner as recited in claim 12, wherein said suction opening which is coupled to an one opened end of a hose and can be directed in an arbitrary direction is an attachment for the upright type vacuum cleaner, said attachment being provided detachably at said one opened end for collecting dust from a relatively narrow space.

19. The upright type vacuum cleaner as recited in claim 18, wherein said attachment is an extension tube for a narrow nozzle for extending said one opened end of said hose to provide said suction opening which can be directed in the arbitrary direction.

20. The upright vacuum cleaner as recited in claim 13, wherein first and third ducts have longitudinal axes thereof disposed in a common plane, and the third duct has a longitudinally axis disposed orthogonally to said common plane.

* * * * *

UNITED STATES PATENT AND TRADEMARK OFFICE
CERTIFICATE OF CORRECTION

PATENT NO : 6,079,077
DATED : June 27, 2000
INVENTOR(S) : KAJIHARA, Shinichiro et al.

It is certified that error appears in the above-identified patent and that said Letters Patent is hereby corrected as shown below:

Column 6, lines 34 and 35, change "second" to --third--;

Column 6, line 37, change "second" to --third--;

Column 7, line 3, change "second" to --third--;

Column 7, line 8, change "second" to --third--;

Column 8, line 2, change "first" to --second--;

Column 8, line 4, change "first" to --second--;

Column 8, line 22, change "second" to --third--;

Column 8, line 27, change "second" to --third--;

Column 8, line 45, change "first" to --second--;

Column 8, line 47, change "third" to --first--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*